US005330013A

United States Patent [19]

Sollami

[11] Patent Number: 5,330,013

[45] Date of Patent: Jul. 19, 1994

[54] DRILL HEAD UNIT

[75] Inventor: Phillip A. Sollami, Herrin, Ill.

[73] Assignee: The Sollami Company, Herrin, Ill.

[21] Appl. No.: 38,390

[22] Filed: Mar. 29, 1993

Related U.S. Application Data

[63] Continuation-in-part of Ser. No. 683,862, Apr. 11, 1991, abandoned, and a continuation-in-part of Ser. No. 947,554, Sep. 21, 1992, abandoned.

[51] Int. Cl.[5] ..... E21C 7/02

[52] U.S. Cl. ..... 173/216; 173/198

[58] Field of Search ..... 173/213, 198, 199, 216, 173/197, 218, 104, 105, 74, 78, 79; 408/226

[56] References Cited

U.S. PATENT DOCUMENTS

| | | | |
|---|---|---|---|
| 2,821,963 | 2/1958 | Curtis | 173/133 |
| 3,719,254 | 3/1973 | Snider | 173/218 |
| 4,190,116 | 2/1980 | O'Neal et al. | 173/198 |
| 4,294,317 | 10/1981 | Amoroso | 173/198 |
| 4,298,073 | 11/1981 | Yates | 173/198 |
| 4,416,337 | 11/1983 | Phillips et al. | 173/198 |
| 4,470,469 | 9/1984 | Coakley et al. | 173/198 |
| 4,856,384 | 8/1989 | Wechner | 173/199 |

*Primary Examiner*—Scott Smith

*Attorney, Agent, or Firm*—Patnaude, Videbeck & Marsh

[57] ABSTRACT

The present invention is an improved drill head unit in which the lower portion of the drill chuck has a lobed shaped cross section which fits into a corresponding lobed shaped opening in a shaft connected to a spiral bevel gear mounted for rotation about a vertical axis. The lobed shaped cross section replaces the spline drive previously used in such units, and the spiral bevel gears replace the bevel gears previously used. An improved and simplified radial elastomeric seal is provided to separate a vacuum pressurized cavity in the housing from a lubricating cavity in the housing, and a locking mechanism locks against the drill steel such that the drill steel can be withdrawn from a drilled hole by lowering the drill head unit.

2 Claims, 13 Drawing Sheets

DRILL HEAD UNIT

The present application is a continuation-in-part of the copending prior applications of the inventors, Phillip A. Sollami and Jimmie L. Sollami, filed Apr. 11, 1991 now abandoned, bearing application Ser. No. 07/683,862 and application Ser. No. 07/947,554 filed Sep. 21, 1992, now abandoned. The present invention relates to improvements in drill head units which are used to drill vertical holes in the ceilings of mine tunnels and more particularly to drill head units which accept hollow drills through which a vacuum or pressurized water can be applied.

BACKGROUND OF THE INVENTION

The present invention relates to drill head units which are used in conjunction with hollow drill bits which have a brazed carbide cutting tip mounted on the end to drill vertical holes in the ceilings of mine tunnels. To protect against falling ceilings in mine tunnels, vertical holes are drilled into solid strata in the ceiling of mine tunnels into which bolts are inserted. The bolts secure covering material to the underside of the tunnel ceiling for the protection of miners.

To drill a vertical hole into the ceiling of a tunnel, a drill head unit is provided which is connected at one end to a horizontally mounted rotary motor and the top thereof is adapted to receive a vertically mounted drill chuck for holding a hollow drill bit in a vertical position. The drill head unit includes a horizontally mounted bevel pinion gear which is driven by a rotary motor and a vertically oriented bevel gear which drives the drill chuck. A typical existing drill head unit can be seen in U.S. Pat. No. 4,294,317.

Existing drill head units, however, have not been satisfactory for a number of reasons. First, the average life of a drill bit used in such units is often considerably less than would be expected from normal wear of the cutting edges of the bit. In many cases, a drill bit is destroyed after drilling through only five to twenty feet of rock.

A second problem with existing drill head units such as shown in U.S. Pat. No. 4,294,317 is that the same drill head unit cannot be used with both a vacuum system and a water system for removing residue stone dust. Residue dust from the drilling tends to drop around the outside of the drill and cover the top of the drill head unit, and when the stone particles enter into the unit, they cause damage to the parts. Existing drill head units have a drill chuck fitted into splines within a bevel gear. The splines in the gear endure a great deal of wear and fail long before the teeth of the gear fail, however, failure of the splines in the gear results in the loss of the entire gear, which is one of the most expensive parts of the unit.

To reduce the accumulation of stone particles and therefore the damage they cause to the parts, a vacuum or water removal system is provided. When a vacuum is used, the vacuum is drawn down through the hollow drill such that stone dust residue is drawn through the drill and out the bottom of the drill head housing. When a water system is used, pressurized water is forced up through the hollow drill and allowed to run out the bottom of the hole in the ceiling of the mine thereby washing away excess stone particles. Although the vacuum removal system is preferred when it is usable because the stone dust can be collected as a part of the removal process, the vacuum removal system is not practical when the drill is required to pass through very hard rock. A great amount of heat is created while drilling through hard rock and the heat drastically reduces the useful life of the carbide drill bit unless the water removal system is used which also provides a coolant to the drill bit.

Existing drill head units such as shown in U.S. Pat. No. 4,294,317 provide for a complicated spring loaded axial seal which seals the vacuum or water chamber of the drill head unit from the lubricated portions of the drill head unit. When such a drill head unit is constructed to be used with a water removal system, one of the surfaces of the axial seal within the drill unit is made of tungsten carbide which is ground smooth to a millionth of an inch tolerance, and the other sealing surface is made of a ceramic material. Such seals have been found to be very expensive to manufacture, and as a result, when such a drill head unit is constructed to be used with a vacuum removal system, a less expensive carbon material is substituted for the tungsten carbide surface of the seal. The carbon seal is adequate in a vacuum removal system, but parts of such a seal are subject to rust and rapidly fail when a drill head unit fitted with such seals is used with a water removal system. It would therefore be desirable to provide a sealing system for such drill head units which is not excessively expensive and for which the same unit can be used with either a vacuum or water removal system.

Several factors in addition to heat contribute to the shortened life of drill bits used in existing units. As previously mentioned, existing units use splines to convey rotational movement from the vertically mounted bevel gear to the drill chuck and drill shaft. When the splines become worn, the drill chuck cannot be accurately centered in the vertically mounted bevel gear. The shaft of the drill bit used in such units is often four to ten feet in length and if the drill chuck is not centered with respect to the vertical bevel gear, the drill bit will cut a hole with an enlarged diameter and cause the drill and portions of the drill head unit to vibrate as the uncentered drill rotates.

Even when a drill chuck appears to have initially been properly centered in the bevel gear at the outset of drilling, the drill chucks of existing drill head units tend to become uncentered during drilling. When drilling commences, the torque conveyed from the bevel gear to the drill chuck locks the drill chuck in the orientation in which it is positioned at commencement of drilling. As the drill passes through alternately hard and soft strata of rock existing drill head units will chatter and cog during which uneven torque loads are transferred from the motor, through the gears to the drill chuck. As a result of the alternate application and releasing of torque to the drill chuck, the drill chuck will become unseated and reseated into a new uncentered orientation causing the drill bit to wear unevenly and vibrate as described above. Such reseating and the excessive wear caused thereby increases as the splines become subject to wear.

In existing drill units used in mining, the drill steel is slidably received within the drill chuck such that, after a hole has been drilled, and the drill unit is lowered, the drill steel and drill bit will remain stuck in the hole. The operator must then manually grasp the shaft of the drill and withdraw it from the hole. In so doing, the operator consumes several seconds of time which becomes a substantial loss when one considers that the time incurred to drill such a hole takes less than a minute. Furthermore, the operator exposes his hands to possible injury while withdrawing the drill steel.

It would, therefore, be desirable to provide a drill head unit which permits the drill chuck to be self-centering and not subject to realignment as a result of the drill passing through strata of alternately hard and soft material and which would eliminate or reduce chatter and cogging and the damage caused thereby. It would also be desirable to provide a drill head unit which has a relatively inexpensive seal which is usable with both a water removal system and with a vacuum removal system. It would also be desirable to provide a drill head unit which will grasp the drill steel such that the drill steel will be retained within the chuck as the drill head is withdrawn from the hole after drilling.

SUMMARY OF THE INVENTION

Briefly, there is provided in accordance with the present invention a new and improved drill head unit for transmitting rotational power from a horizontally mounted motor to a vertically oriented hollow drill bit. The drill head unit has an improved inner seal so that it may be used either with a vacuum dust removal system or with a water dust removal system. The unit also has an improved method for retaining the drill chuck and a spiral bevel gear drive between the motor and the drill bit to greatly reduce the causes of breakage and excessive wear of the drill bit.

In accordance with the present invention, a first spiral bevel pinion is adapted to be coupled to the shaft of a drive motor and drives a second spiral bevel gear to which a tubular drill chuck is non-rotationally affixed. The drill chuck has a cross-sectional external configuration having three lobes and fits into a complementary shaped bore in a shaft within the second spiral bevel gear. The drill chuck will be self-centered within the vertical shaft because the three lobes positioned around the axis of the drill chuck each exert an inward component of force upon the drill chuck, and the inward forces are balanced only when the drill chuck is centered. Such a drill chuck will be self-centered even after these parts have become worn. The drill chuck engages the drill steel at positions located at about 13 degrees from the crest of each lobe such that the metals of the drill shaft and the drill chuck are radially deflected inwardly by the inward components of the forces applied to the lobes. As the drill passes through alternately hard and soft strata, the deflection of the drill chuck and drill steel will absorb a substantial amount of the shock which in prior devices was absorbed between the teeth of the bevel gears. At the same time, the inward forces against the drill chuck and drill steel lock these parts together.

Bevel gears which are not spiralled generally have only one tooth of each gear in engagement with the outer gear at any instant. Such gears are not able to convey rotational power from one gear to another without a certain amount of play as the gears rotate against each other because of limitations of the tolerances to which the gears can be made. Spiral bevel gears, on the other hand, provide for two and one-half to three teeth of each gear to be in engagement with a like number of teeth of the other gear at any instant, and such gears can be constructed to substantially eliminate play between the gears. The lobed cross-sections of the drill chuck and the complementary receiving vertical recesses in the drive shaft, and the spiral bevel gearing combine to substantially eliminate the rotational play between the motor driven shaft and the drill fitted into the drill chuck. As a result of the foregoing, torque is continuously applied from the motor to the drill shaft and chatter and cogging, and the adverse effects caused thereby are greatly reduced or eliminated.

Carbide drill bits used in a drill head unit in accordance with the present invention will have substantially longer life because they will not be subjected to the shock transmitted up the drill shaft as a result of chatter or cogging within the unit. Also, a drill chuck according to the present invention is self-aligning and will not become misaligned during the drilling operation as was the case with prior art drill head units. As a result of the above, the gears of the drill head unit may be made of a harder and more brittle steel, which will give the unit a longer usable life.

The present invention further includes a hollow cylindrical shaft having an upper end for receiving a drill chuck and a lower distal end having an annular transverse face. An upwardly extending tubular member in the housing has an upper distal end also has an annular transverse face spaced from the annular face of the shaft. An annular groove or a shoulder in one of the annular faces receives an annular seal affixed to the other annular face, and the seal seals radially against the cylindrical sides of the groove or against the cylindrical side of the shoulder.

The seal has a U-shaped spring which forces an inner annular sealing lip radially inwardly and an outer annular sealing lip radially outwardly. The annular seal seals between the lower end of the hollow shaft and the upper end of the upwardly extending tubular member and thereby seals the inner chamber of the drill head unit from the gear cavity. This seal is less expensive to make than the seal of existing units, and the seals enable the unit to be interchangeably used with either a vacuum or a water removal system, and not be subject to rusting of the parts as is the case of prior art drill head units.

Another feature of the present invention is a pressure actuated releasable lock for locking the drill chuck to the hollow drill steel. After the drilling of a hole, the drill head unit is lowered with the drill locked into the unit. As the unit is lowered it will withdraw the drill steel from the hole without assistance from the operator.

GENERAL DESCRIPTION OF THE DRAWINGS

The present invention will be better understood by reading the following detailed description taken in connection with the accompanying drawing wherein.

DETAILED DESCRIPTION OF THE PREFERRED EMBODIMENT

Figure 1:
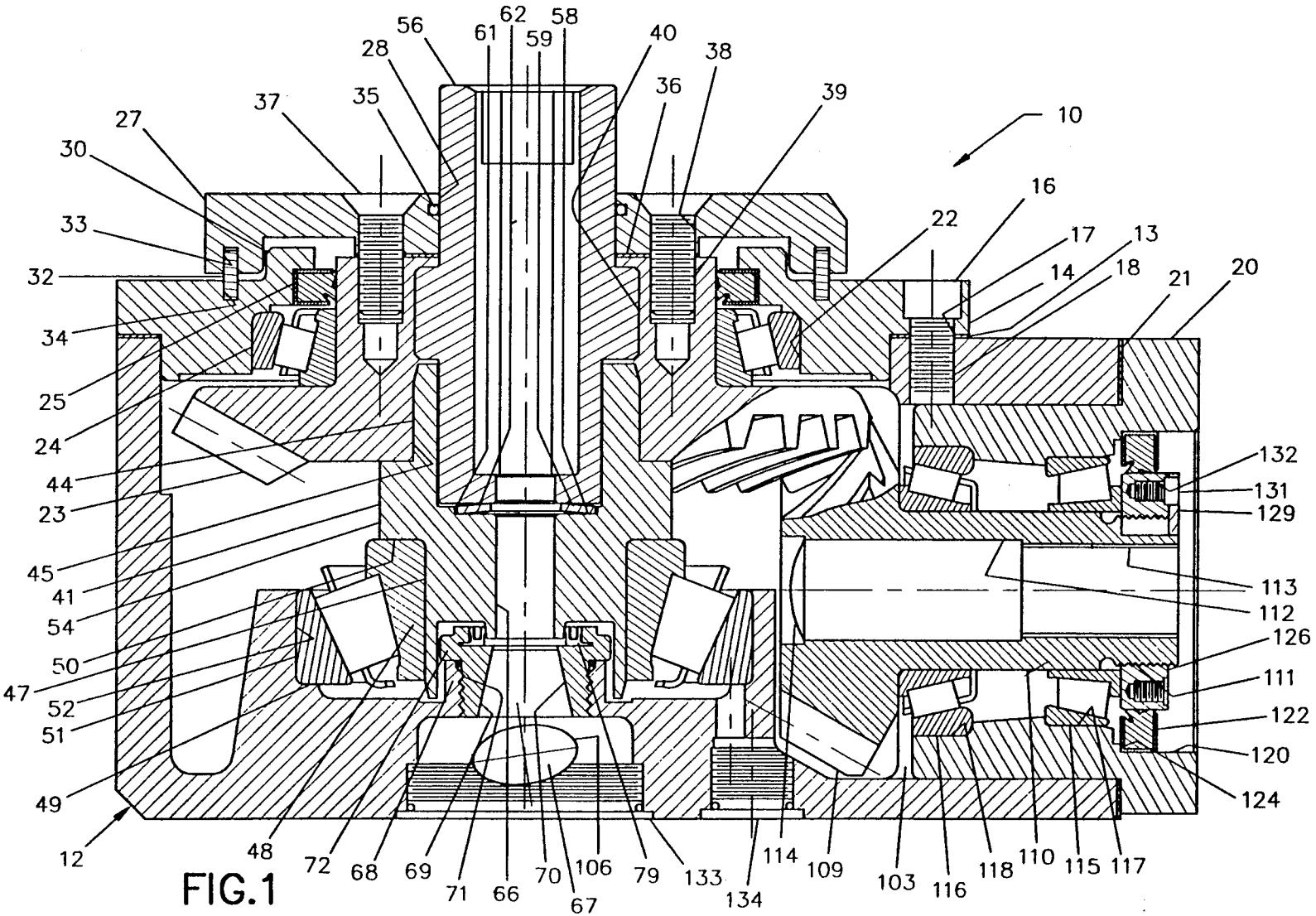
FIG. 1 is a cross-sectional view of a drill head unit embodying the present invention.

Referring to FIG. 1, a drill head unit 10 has an exterior housing 12, having a cavity 11, and across the top of the housing 12 is a cover plate 14 between which is a plastic and aluminum laminated shim 13. A plurality of spaced bolts 16 pass through a plurality of aligned holes 17 in the cover plate 14 and in the shim 13, and are tightly screwed into a corresponding plurality of threaded holes 18 in the housing 12 to compress the shim and to seal the cavity 11 in the housing from the ambient. At one side of the housing 12 is a bearing holder 20, and between the housing 12 and the bearing holder 20 is a second laminated shim 21. The bearing holder 20 is also secured to the housing 12 by a plurality of spaced bolts, not shown, passing through aligned holes, also not shown, in the bearing holder 20 and the shim 21 and into corresponding threaded holes in the housing 12. These bolts are also tightened to seal the cavity 11 in the housing from the ambient. The cover plate 14 has a central aperture 22 adapted to accommodate the upper tubular portion of a vertically mounted first spiral bevel gear 23 journaled in a bearing 24. Lubricating oil is retained within the housing 12 by a seal 25 located between the cover plate 14 and the spiral bevel gear 23. A dust cover 27 is provided with a bore 28 and has an outer lip 29 which overlaps an annular ridge 30 on the cover plate 14. An annular steel slinger ring 32 is retained in a groove 33 in the cover plate 14.

The ring 32 extends loosely into a grease filled annular groove 34 in the dust cover 27. Grease is injected into the space under the dust cover through a Zerk fitting, not shown. An 0-ring seal 35 is positioned between the bore 28 of the dust cover 27 and a drill chuck 56 inserted therein as described below. The dust cover 27 is secured to the first spiral bevel gear 23 by a plurality of bolts 37 which extend through a plurality of holes 38 in the dust cover 27 and are screwed into a corresponding plurality of threaded holes 39 in the spiral bevel gear 23. A third shim 36 located between the spiral bevel gear 23 and the dust cover 27 prevents leakage between these two parts. The spiral bevel gear 23 has a central longitudinal opening 40.

Figure 3:
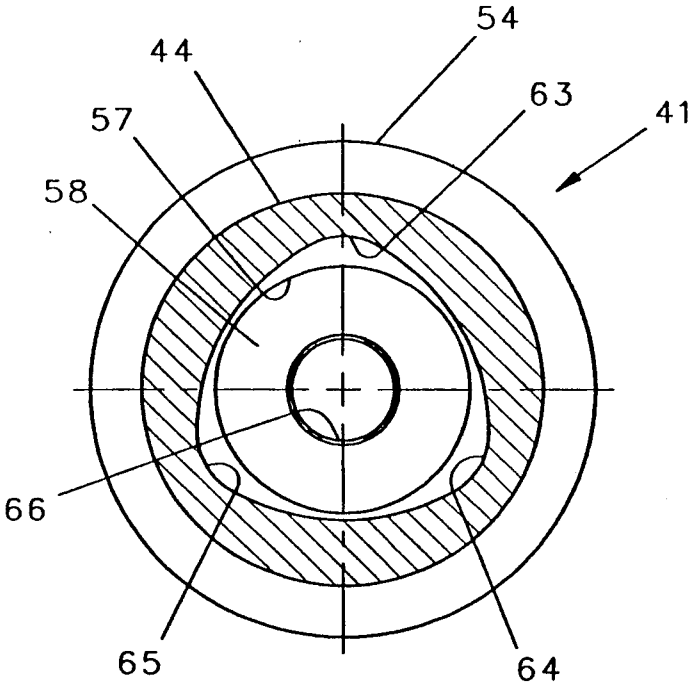
FIG. 3 is an end cross sectional view of the shaft shown in FIG. 2 taken through lines 3—3 thereof.
Figure 2:
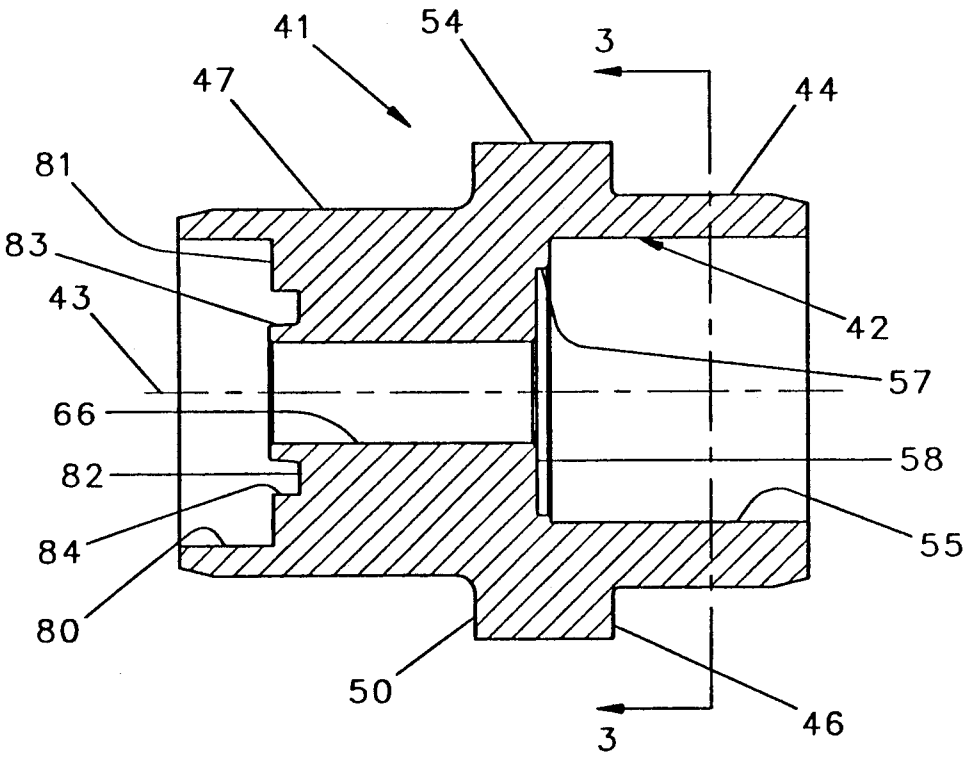
FIG. 2 is an enlarged cross-sectional view of the shaft which is fitted into the vertical spiral bevel gear.

Referring to FIGS. 1, 2 and 3, a vertically oriented shaft member 41 having a cylindrical bore 42 through the longitudinal axis 43 thereof is located coaxially with and below the first spiral bevel gear 23. The shaft member 41 has an upper cylindrical section 44 which tapers inwardly at the upper end thereof. The diameter of the upper cylindrical section 44 is a little larger than the inner diameter of the central opening 40 of the spiral bevel gear 23 such that the upper cylindrical section 44 of the shaft 41 can be forced tightly into the lower end 45 of the central opening 40 in the spiral bevel gear 23 until the lower end 45 of the spiral bevel gear 23 abuts an upwardly facing annular shoulder 46 of the shaft member 41.

The shaft 41 further has a lower cylindrical section 47 around which is fitted the inner race 48 of a lower bearing 49. The upper edge of the inner race 48 of the lower bearing 49 abuts against a downwardly facing annular shoulder 50 on the shaft 41 to convey an upward thrust to a drill bit. The outer race 51 of the lower bearing 49 is fitted into a cylindrical bore 52 in the housing 12, and the bottom of the lower bearing 49 rests on an annular ridge 53 around the inner circumference of the cylindrical bore 52. Between the downwardly facing shoulder 50 and the upwardly facing shoulder 46 is a central cylindrical section 54.

The bore 42 in the shaft 41 has an upper section 55 with a large diameter and is adapted to slidably accept the lower portion of a drill chuck 56 and has a non-circular bore to convey rotational force to the drill chuck 56. Below the upper section 55 is a cylindrical bore 57 and at the bottom of the cylindrical bore 57, an annular shoulder 58. A spring loaded washer 59 is fitted within the bore 57 above the annular shoulder 58. The washer 59 has an outer diameter 61 which rests upon the shoulder 58, but then inner diameter 62 of the washer 59 is displaced upwardly. The washer 59 is made of a spring metal such that vertical shock incurred as a drill bit fitted in the unit 10 encounters alternately hard and soft rock will compress the inner diameter 62 against the shoulder 58 and thereby absorb a portion of the shock. As best shown in FIG. 3, the upper section 55 of the bore 42 has three symmetrically arranged lobe-like recesses 63, 64, 65 which are adapted to receive the lower end of the drill chuck 56 which has a complementary shaped cross section and is described in detail below. The central section 66 of the bore 42 has a reduce diameter which extends a passage down to a second cavity 67 in the bottom of the housing 12.

Figure 4A:
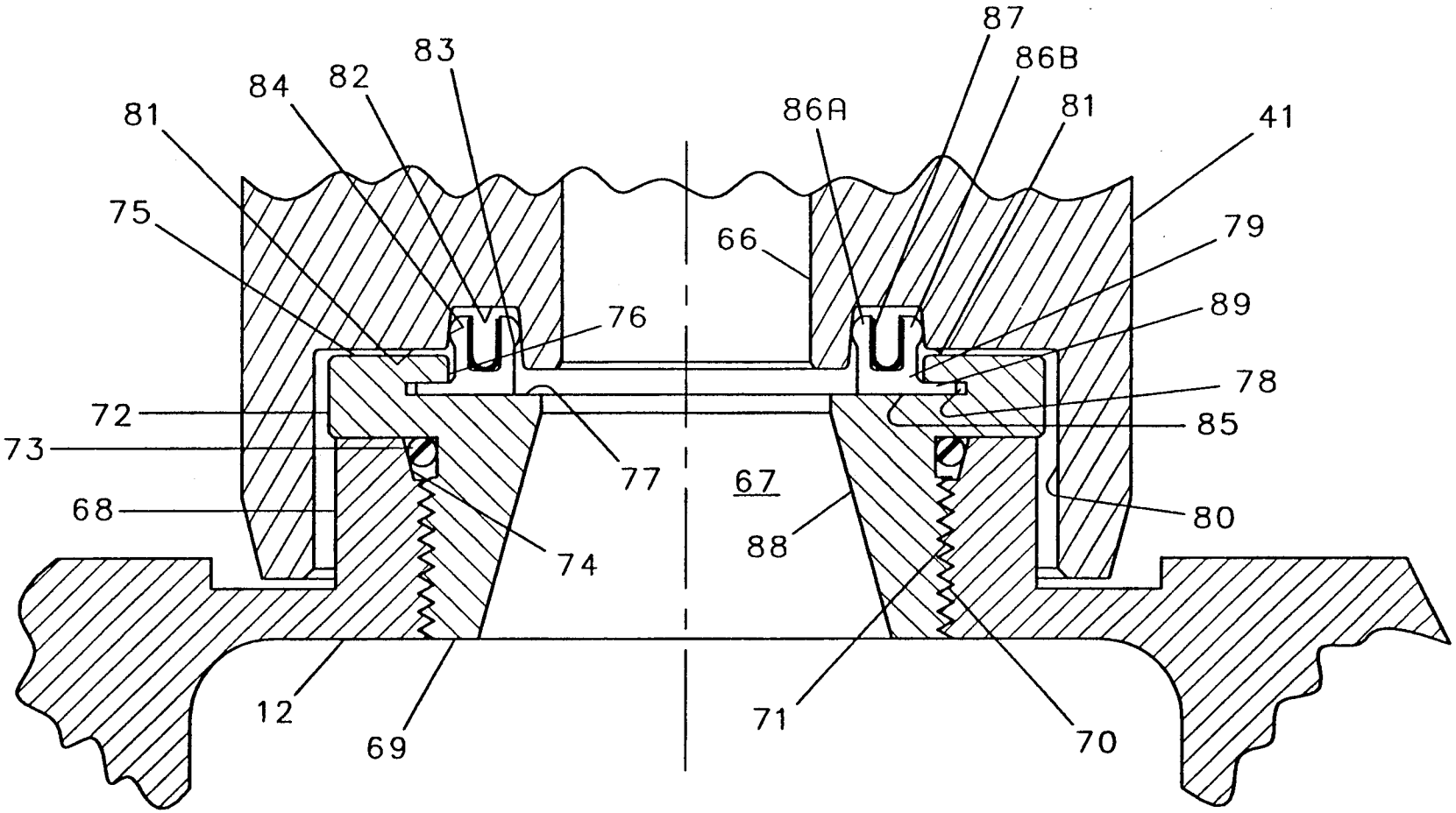
FIG. 4A is an enlarged fragmentary view of a portion of FIG. 1 showing the seal separating the cavities of the housing.

As shown in FIG. 4A, the bottom of the shaft 41 is fitted around a tubular upward projection 68 of the housing 12 into which is fitted a tubular plug 69. The plug 69 is stationary and has a lower tubular section 70 with exterior threads which fit into complementary threads in the bore 71 in the tubular projection 68 in the housing 12.

The plug 69 has an upper external flange 72 which has an outer diameter equal to the outer diameter of the tubular projection 68. An 0-ring 73 is received in a counter bore 74 around the upper end of the bore 71 of projection 68 and the 0-ring 73 is compressed between the bore 71 of the projection 68 and the bottom of the flange 72 of the plug 69 to seal against leakage between these parts.

In accordance with the present invention, at the top of the plug 69 there is a counterbore 76 and at the bottom of the counterbore 76, an annular transverse shoulder 77. An annular undercut 78 made within the wall of the counterbore 76 extends the shoulder 77 radially outward. Fitted within the undercut 78 and extending around the inner surface of the counterbore 76 is an annular seal 79.

A counterbore 80 at the bottom end of the shaft 41 is adapted to receive the plug 69 and the tubular projection 68. The diameter of the counter bore 80 is a little larger than the outer diameter of the projection 68 or the flange 72 such that the shaft 41 may freely rotate around these parts. At the upper end of the counterbore 80 is an annular shoulder 81 which is spaced a short distance above the upper end 75 of the plug 69. Machined axially into the shoulder 81 is an annular groove 82 having an inner cylindrical side surface 83 and an outer cylindrical side surface 84.

The seal 79 has a planar transverse end 85 which abuts against the shoulder 77 of the plug 69, and an external flange 89 which is adapted to fit into the undercut 78. To prevent rotation of the seal 79 within the undercut 78, the cylindrical surface the edge of the counterbore 76 is staked so as to be compressed against the flange 89. The seal 79 further has an inner annular sealing lip 86A and an outer annular sealing lip 86B and between the two lips 86A, 86B, a U-shaped spring 87. The sealing lips 86A, 86B are adapted to extend within the annular groove 82 with the inner annular lip 86A abutting against the inner cylindrical surface 83 and the outer annular lip 86B abutting against the outer cylindrical surface 84 of the groove 82.

The U-shaped spring 87 exerts force against the lips 86A and 86B forcing them away from each other such that the sealing lips 86A, 86B are forced against the abutting inner and outer cylindrical surfaces 83, 84, respectively. To insure a good long-lasting seal between the seals 79 and the parts which rotate in contact with the seal, in this case the cylindrical surfaces of the groove 82, the sealing surfaces 83, 84 are made of case hardened alloy steel and are highly polished.

The plug 69 has an axial bore 88 which is aligned coaxial with the bore 42 of the shaft 41 and extends a passage through a tubular drill bit fitted in the unit 10 to a second cavity 67 in the bottom of the housing 12. As can be seen in FIG. 4A, and also in FIGS. 4B, 4C, and 4D which will be discussed below, the bore 88 through the plug 69 is tapered to diverge at the lower end thereof to allow the flow of material to turn into the passages 105 or 106 without becoming congested, as described below.

Figure 5:
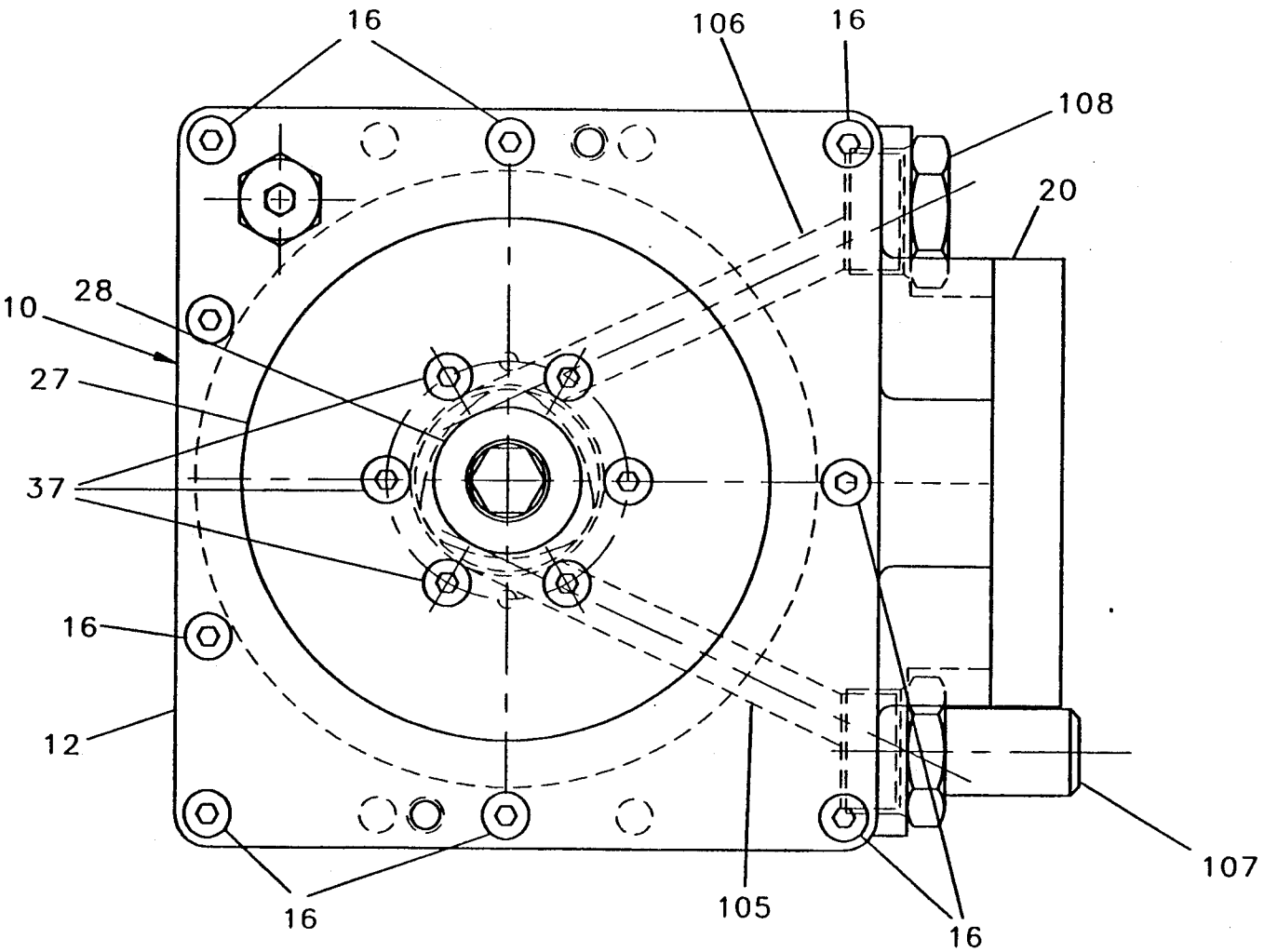
FIG. 5 is a top view of the drill head unit shown in FIG. 1.

Referring to FIG. 1 and FIG. 5, the interior of the housing 12 consists primarily of the gear cavity 11. However, immediately under the shaft 41 is the second vacuum or water cavity 67. A passage 105 extends from the second cavity 67 to a port 107 through which a vacuum or pressurized water running to the drill chuck 56 can be applied as described above. As shown in FIG. 5, the alternate passage 106 from the second cavity 67 is sealed against the ambient by a plug 108.

Referring to FIG. 1, the spiral bevel gear 23 is driven by a horizontally oriented spiral bevel pinion 109 having a hollow cylindrical integral shaft 110 at the end of which is a threaded section 111. The cylindrical shaft 110 has a central longitudinal bore 112 which is adapted to accept the shaft of a motor, not shown. An internal spline 113 is provided in the bore 112 of the shaft 110 for locking the shaft to the motor, and a plug 114 is provided at the inner end of the bore 112 to prevent leakage of lubricating fluids into the bore 112. The pinion 109 is journaled for rotation in a pair of bearings 115 and 116 which are in turn fitted within cylindrical bores 117 and 118 in the bearing holder 20. A counterbore 120 in the bearing holder 20 retains a stationary elastomeric seal 122 which abuts against a shoulder 124.

An elastomeric seal 122 is compressed against the outer surface of a ring 126 which has a threaded bore 128 which receives the threaded section 111 of the pinion 109 to retain the bearings 115 and 116 in place. The ring 126 is itself retained in position by a retaining key 129 which projects into a key slot, not shown, in the pinion 109 and a screw 131 which passes through the key 129 and into a threaded hole 132 and the ring 126 secures the key 129 to the slot. The bottom of the lower cavity 67 is accessible through a first plug 133, and the bottom of the gear box is accessible for draining oil and the like through a second plug 134.

Figure 6:
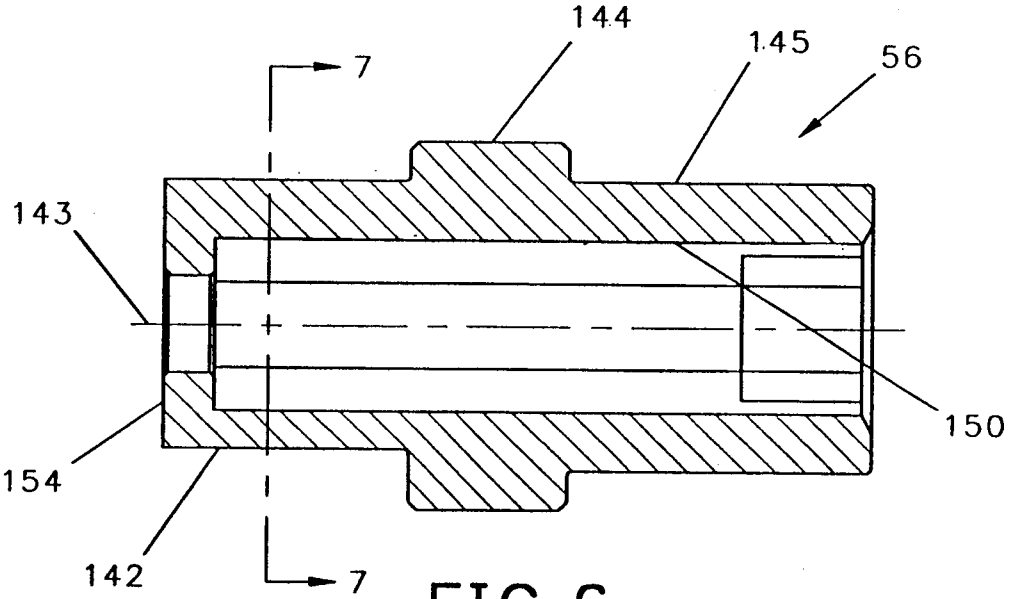
FIG. 6 is a cross sectional view of the drill chuck in accordance with the invention.
Figure 7:
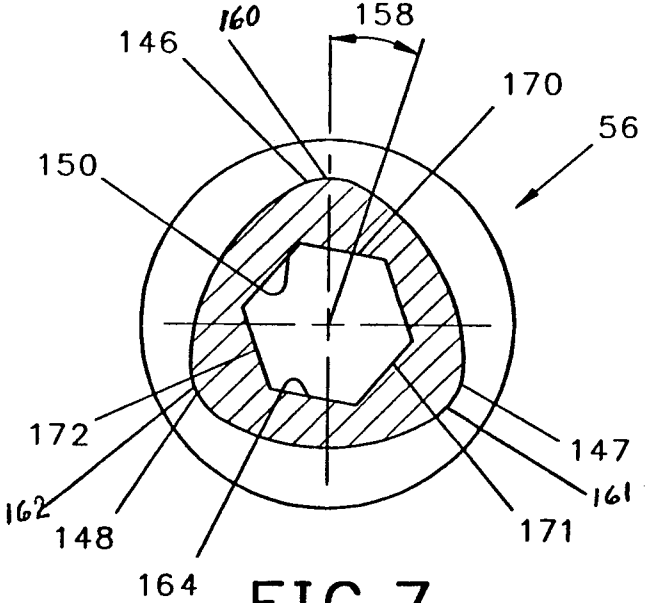
FIG. 7 is a cross sectional view of the drill chuck shown in FIG. 6 taken through lines 7—7 thereof.
Figure 8:
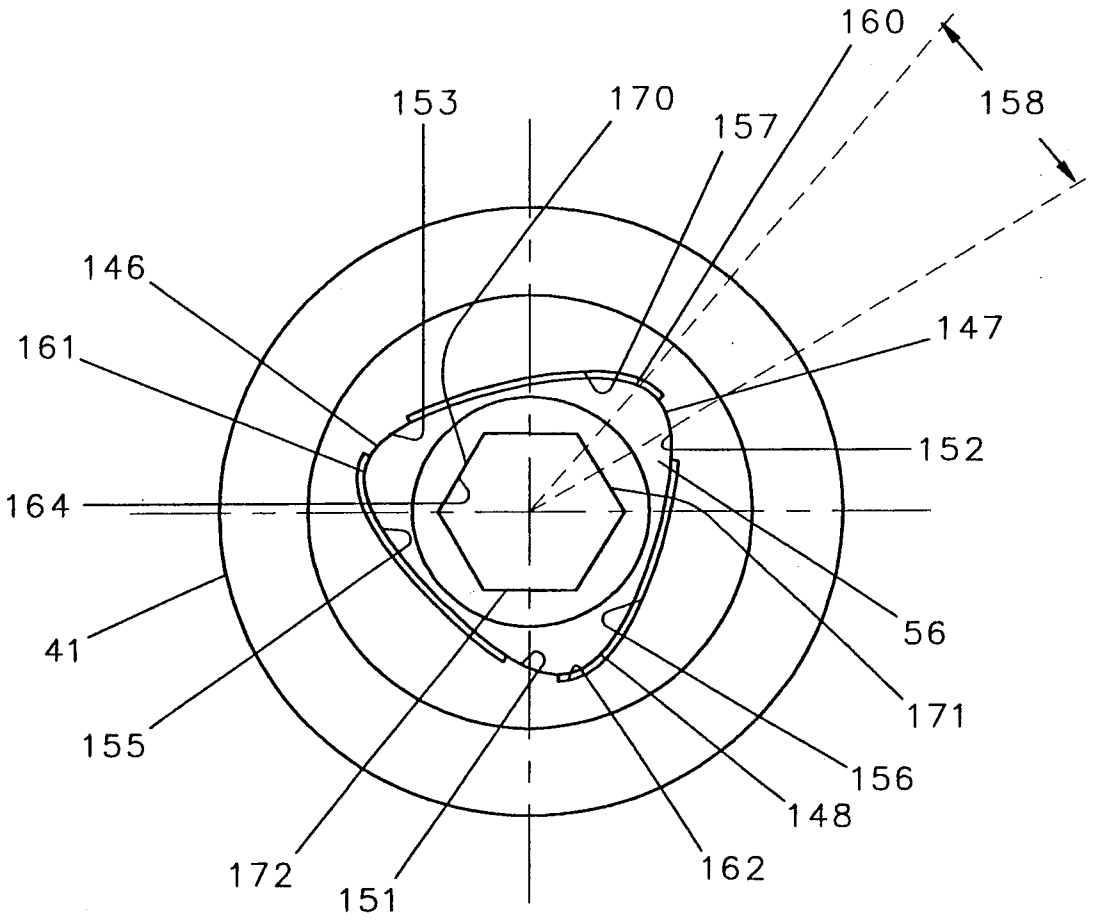
FIG. 8 is a cross-sectional view of the shaft shown in FIG. 3 with the relief areas of the boring accentuated and with the drill chuck shown in FIGS. 6 and 7 inserted therein.

The drill chuck 56, which is shown in FIG. 6, FIG. 7 and FIG. 8 has an outer lower section 142 which has an exterior profile having three lobes 146, 147, 148. The lobes 146, 147 148 are of equal size and are equally spaced about the axis 143 of the drill chuck 56 and shaped generally complementary to the recesses 63, 64, 65 of the upper portion of the shaft 41. The lobes 146, 147, 148 of the drill chuck 56, therefore, slidably fit into the recesses 63, 64, 65 in the shaft 41 and transfer rotational power from the shaft 41 to the drill chuck 56.

The drill chuck 56 further has a cylindrical central section 144 which is adapted to fit within the central opening 40 of the first spiral bevel gear 23 between the upper end of the shaft 41, and under the dust cover 27, and it has a cylindrical upper section 145 which extends upwardly through a central opening 28 in the dust cover 27. Internally, the drill chuck 56 has a longitudinal bore 150 which has hexagon cross section for retaining the distal end of a drill steel, and at the bottom end, an internal flange 154 for exerting upward thrust to the bottom of the drill steel.

As can be seen in FIG. 8, in which the contour of the recesses within the bore 42 is the shaft 41 are exaggerated, it can be seen that the recesses of the bore 42 have contact areas 151, 152, 153 and relief areas 155, 156, 157 such that rotational force is imparted from the shaft 41 to the drill chuck 56 across the contact areas 151, 152, 153 and not across the relief areas 155, 156, 157. The contact areas 151, 152, 153 are positioned with an angle 158 of between about 8 degrees and about 30 degrees from the portions of the recesses 63, 64, 65 which receive the crests 160, 161, 162 of the lobes 146, 147, 148 of the drill chuck 56. In the preferred embodiment, the contact areas 151, 152, 153 are positioned 13 degrees from the portion of the recesses which receive the crests 160, 161, 162 of the drill chuck 56. Also, the bore 150 of the drill chuck 56 has a central hexagon section 164 therein to receive a hollow drill steel 165 having a complementary shaped hexagonal cross section. As shown in FIG. 8, the hexagonal section 164 in the drill chuck 56 is oriented such that the contact areas 151, 152, 153 of the shaft 41 will be radially outward from flats 170, 171, 172 of the hexagonal drill steel 165, that is the flats 170, 171, 172 are rotated through angle 158 from a position radially inward of the lobes 146, 147, 148.

When the shaft 41 is fitted with a drill chuck 56 as described above, the shaft 41 will apply a force which is directed perpendicular to the contact areas 151, 152, 153. Therefore, the largest component of the force is directed radially inward toward the axis 143 of the drill chuck 56, and a much smaller component of force is directed tangential to the drill chuck 56. As a result of the contact areas being oriented as described, shock incurred as the drill alternately passes through hard and soft stone will cause compression of the walls of the drill chuck 56, compressing the sides of the drill chuck 56 against the walls of the hollow drill steel 165 fitted therein. During the passage of the drill from soft to hard rock, approximately 18,000 pounds of force may be directed radially toward the axis 143 of the drill chuck 42 and the outer surface thereof will deflect up to 0.02 inches. The deflection of the drill chuck 56 will, therefore, absorb some of the shock to the parts and extend the life of the carbide cutting edge of the carbide tip, not shown.

Also, the 13 degree angle of the contact areas 151, 152, 153 from the portion of the recesses 63, 64, 65 which receive the crests 160, 161, 162 of the lobes is not so small that the drill chuck 56 will remain locked with the spiral bevel gear 23 after drilling is completed, yet the angle is such that a very high component of force is directed radially inward to absorb shock as described above.

When a hollow drill having a hexagon drill steel 165 is inserted into the upper end of the central bore 150 in the drill chuck 56, and the lower lobed section 142 of the drill chuck 56 is fitted into the recesses 63, 64, 65 of the shaft 41 there is a passage through the hollow drill to the lower cavity 67.

The spiral bevel gear drive provides for the engagement of approximately two and a half teeth of the gear 23 and the pinion 109 at all times instead of the engagement of only one tooth or less at a time as with ordinary bevel gears, such that the gears mesh substantially without play between them. As a result, the shock to the parts incurred while drilling through hard and soft rock is borne within the flexible portions of the unit 10 including walls of the drill chuck 56 and the washer 59, is reduced within the spiral bevel gears, which thereby reduces the chattering and cogging which would otherwise occur. Accordingly, the use of the lobed drill chuck drive and the spiral bevel gears reduces wear to the gear teeth and to the drill bit. This is particularly important in reducing breakage of the relatively brittle carbide bits.

The spiral bevel gears provided in accordance with the present invention are spiralled in a direction such that the gears themselves convey some of the upward thrust to the drill chuck and drill. As a result, the thrust born by the lower bearing 49 is reduced, and its life is therefor extended.

The elastomeric seal 79 having annular lips 86A, 86B fitted between the inner and outer cylindrical surfaces 83, 84 of the groove 82 separates the two cavities 11, 67 of the housing 12 from one another and enable the same unit to be used with either a vacuum dust removal system or a pressurized water removal system. This seal 79 is relatively inexpensive compared to the tungsten carbide seals used in prior art units adapted to use water removal systems as described above. When a vacuum is applied through the port 107 to the lower cavity 67 to the drill bit, the lubricant in the gear cavity 11 will be under greater pressure than the vacuum in the lower cavity 67. In that event the spring loaded inner lip 86A of the seal 79 will be compressed against the cylindrical side surface 83 of the groove 82 and thereby seal against leakage of the lubricants from the gear cavity 11 into the lower cavity 67. On the other hand, when pressurized water is applied through the port 107, the water will be at a higher pressure than the lubricants in the gear cavity 11. In that event the outer lip 86B of the seal 79 will be compressed against the outer cylindrical side surface 84 of the groove 82 and thereby seal against leakage of water into the gear cavity 11. Therefore, this seal is well suited for use in a unit which can be used with either a vacuum or a pressurized water system.

Figure 4B:
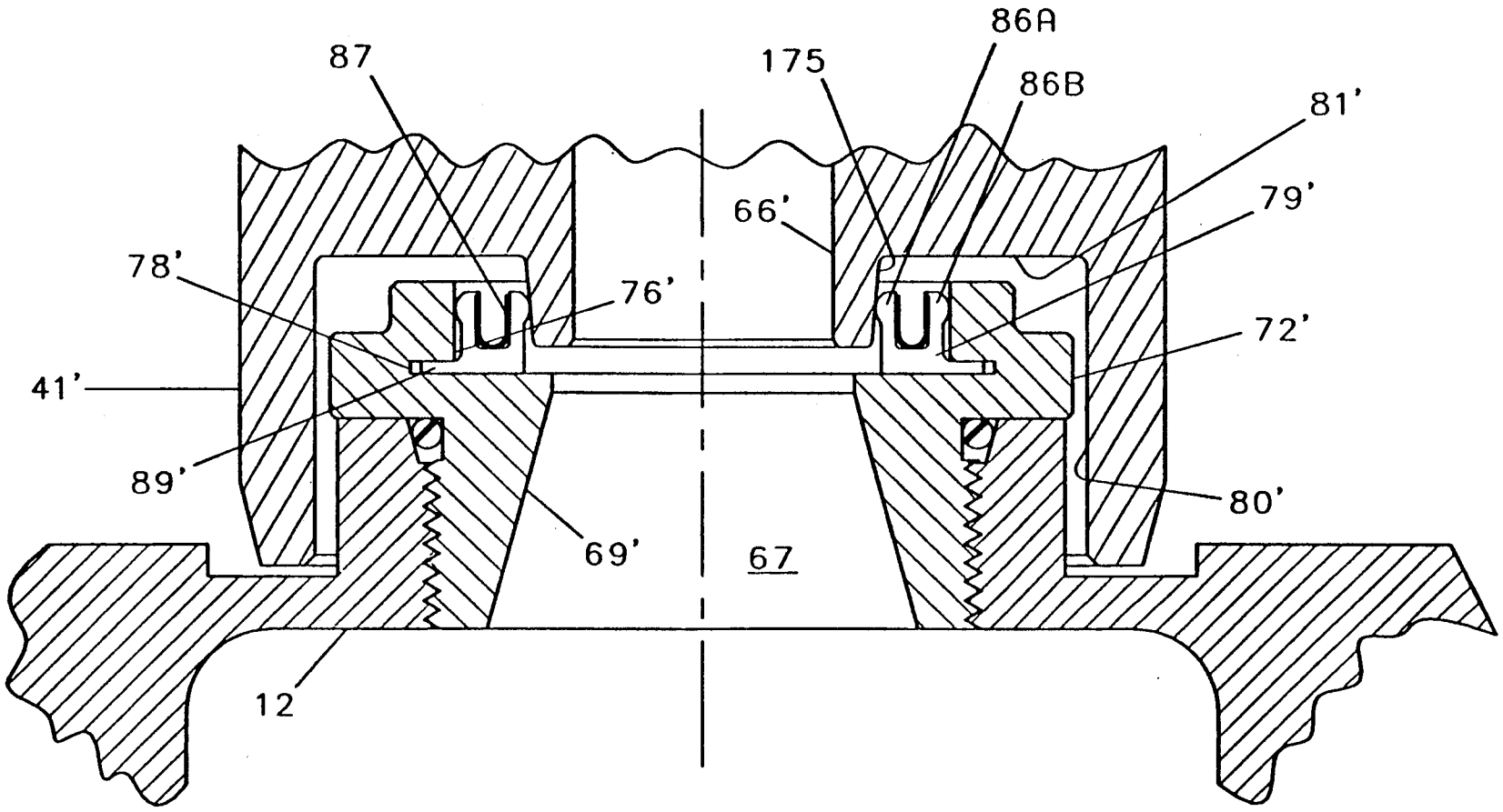
FIG. 4B is an enlarged fragmentary portion of FIG. 1 showing an alternate arrangement of the seal separating the cavities of the housing.
Figure 4C:
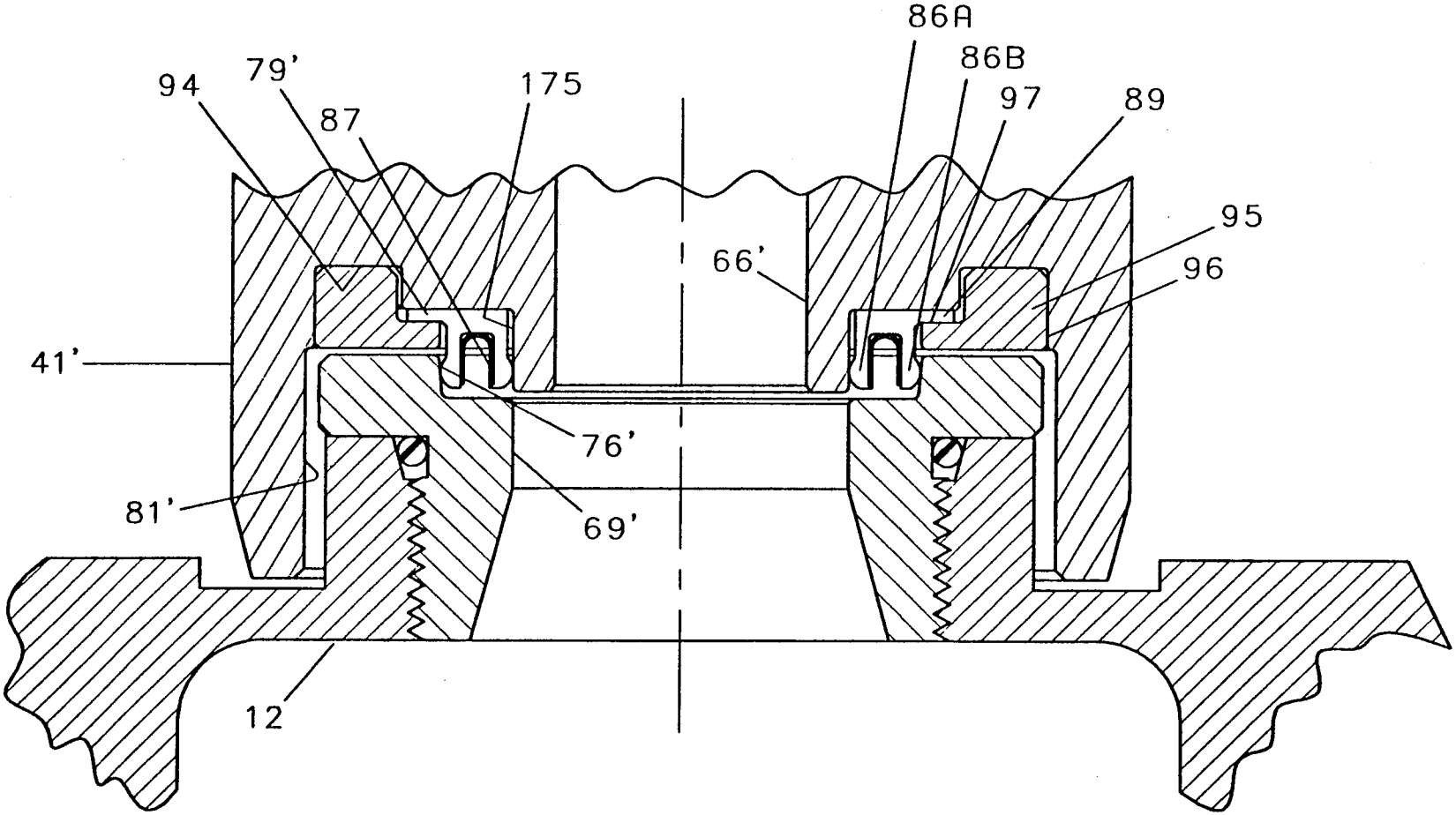
FIG. 4C is an enlarged fragmentary portion of FIG. 1 showing a second alternate arrangement of the seal separating the cavities of the housing.
Figure 4D:
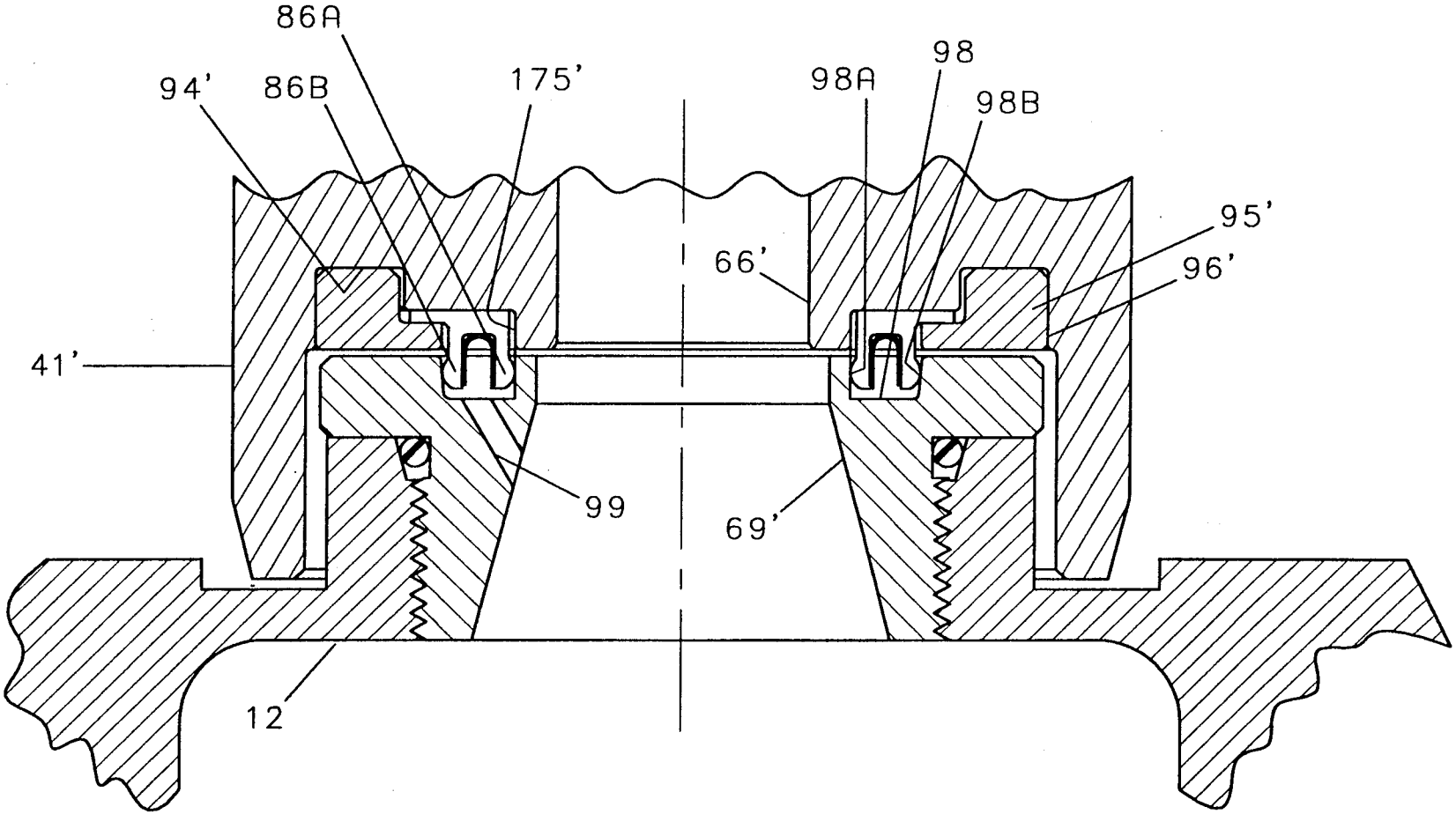
FIG. 4D is an enlarged fragmentary portion of FIG. 1 showing a third alternate arrangement of the seal separating the cavities of the housing.

Alternate embodiments of the seal 79 between the plug 69 and the shaft 41 are shown in FIG. 4B, 4C and 4D. In these embodiments, elements which are identical to elements shown in FIG. 4A have like identical numbers, and elements which are similar to elements as shown in FIG. 4A but are not identical have like indicia numbers, but they are primed. In the embodiment shown in FIG. 4B, the shaft 41' does not have an annular groove 82, but has a tubular lip 175 surrounding the lower end of the central section 66 of the bore 42. The inner spring lip 86A is compressed against the outer side surface of the tubular lip 175, and the outer spring lip 86B is compressed against the inner side surface of the counterbore 76' in the plug 69. In this embodiment, the inner spring lip 86A of the seal will provide a good seal against leakage of lubricants when a vacuum is applied to the lower cavity 67.

In the embodiment shown in FIG. 4C, the shaft 41' has a tubular lip 175' similar to the embodiment in FIG. 4B and also an axial groove 94 in the outer circumference of the shoulder 81'. A retaining ring 95 having tubular portion 96 is adapted to be retained in the axial groove 94 by any suitable means such as threads, not shown, or being press fitted within the outer wall of the groove 94. An interior flange 97 on the retaining ring 95 is adapted to fit over the exterior flange 89 of the seal and thereby retain the seal 79. In this embodiment, the outer lip 86B of the seal 79 is compressed against the inner side surface of a counterbore 76' in the plug 69' and the inner lip 86A is compressed against the cylindrical side surface of the tubular lip 175'. This embodiment of the seal is primarily suitable for use with a pressurized water removal system.

In the embodiment shown in FIG. 4D, the shaft 41' has a tubular lip 175' and an axial groove 94' and a retaining ring 95' similar to that shown in FIG. 4C. In this embodiment, however, an axial groove 98 is machined into the upper end of the plug 69' into which the lips 86A, 86B of the seal 79 are fitted. The provision of a pressure hole 99 between the bottom of the groove 98 and the inner cavity 67 can be provided and it will assist in sealing when the pressurized water removal system is used. When pressurized water is applied to the lower cavity 67, the outer lip 86B is compressed against the outer cylindrical wall 98B of the groove 98. This embodiment of the seal is also usable with a vacuum removal system in which case the inner lip 86A of the seal 79 is compressed against the inner cylindrical side surface 98A of the groove 98 to make a good seal.

The tapered bore 102 at the bottom of the plug 69 replaces a cylindrical boring of prior drill head units. This taper bore allows water or air flowing through the shaft 41 and plug 69 to turn into or out of the passage 105, 106 without creating a build up of stone dust or unnecessarily reducing the pressure of the air or water in the passage.

The three lobe profile of the drill chuck 56 which fits within a complementary shaped bore 55 machined in the shaft 41 replaces the spline drive of prior drill head units. The three lobe configuration is less expensive to manufacture than a spline drive, and is less affected by wear.

Another consequence of the three lobed drill chuck 56 is that the radially inward forces from the three contact areas 151, 152, 153 must balance against each other, and as a result the drill chuck 56 will self-center within the bore 55 of the shaft 41 at the commencement of drilling. A drill chuck 42 having the three lobe configuration will be self-centering even after it has endured a considerable amount of wear much as the legs of a three legged stool will substantially equally bear the weight centered on the stool even when the legs are not of equal length or not positioned on a level surface.

Another embodiment of a drill head unit is shown in FIGS. 9, 10, 11, 12, 13 in which parts which are like those in the first embodiment have like indicia numbers except that they are primed. In this embodiment the unit 10' is provided with a hydraulic locking mechanism 180.

Figure 9:
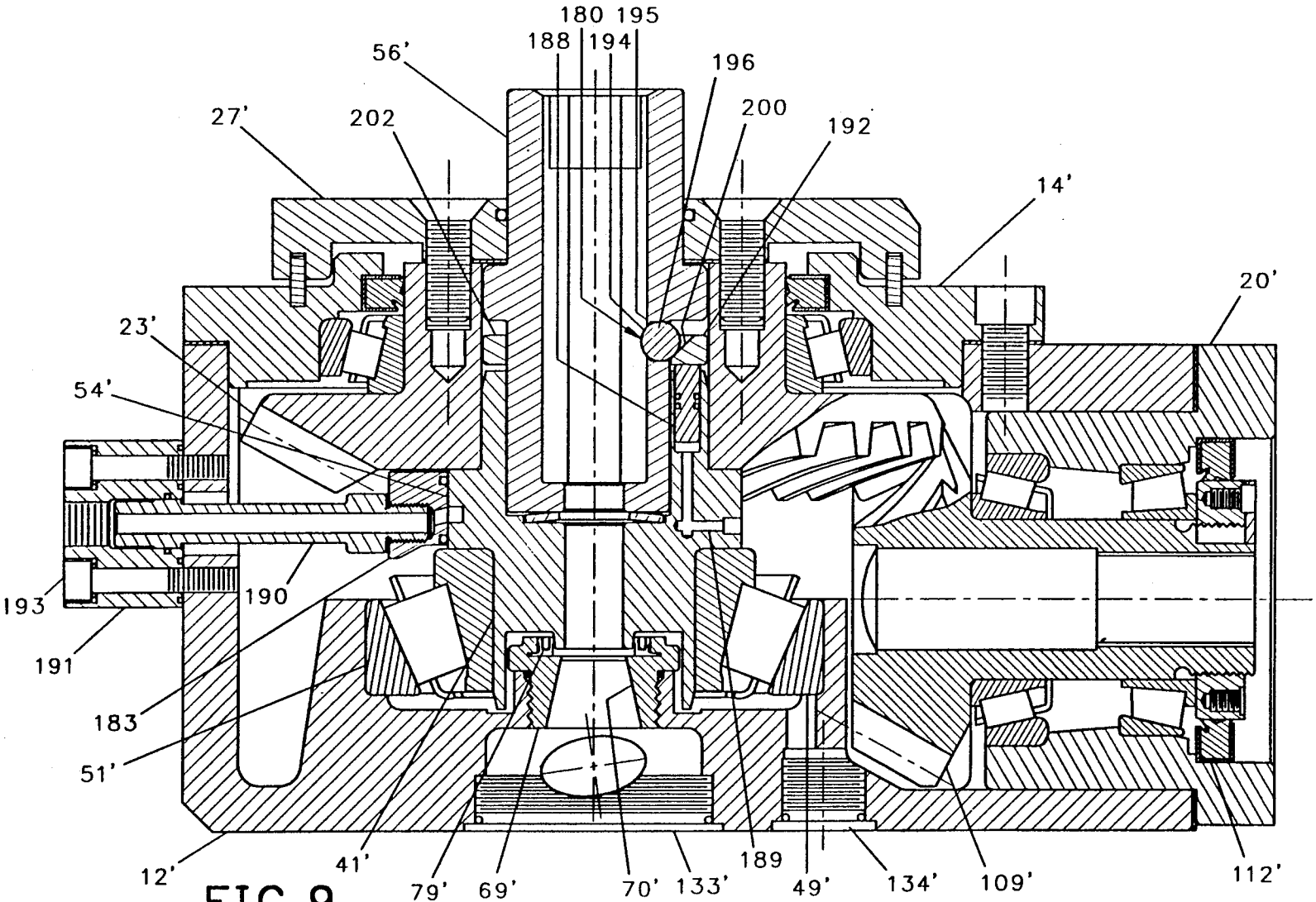
FIG. 9 is a cross-sectional view of a second embodiment of a drill head unit in accordance with the present invention.

As best shown in FIG. 9, the centrally located enlarged cylindrical section 54' of the shaft 41 has midway along the length thereof an annular groove 181 and surrounding the centrally located cylindrical section 54' is an annular collar 183 having an inner diameter which is a little larger than the outer diameter of the cylindrical section 54' so as to permit the free rotation of the shaft 41' within the collar 183.

Figure 11:
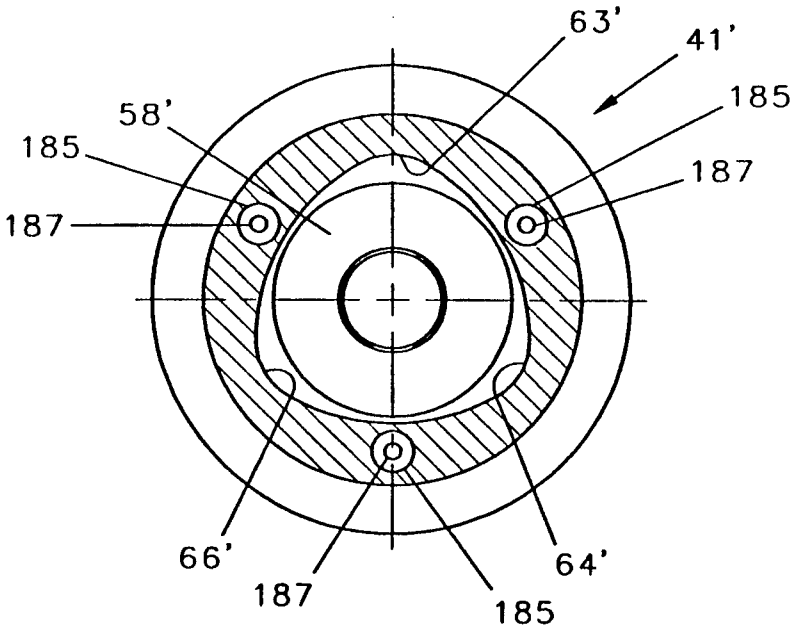
FIG. 11 is a cross sectional view of the shaft shown in FIG. 10 taken through line 11—11.
Figure 10:
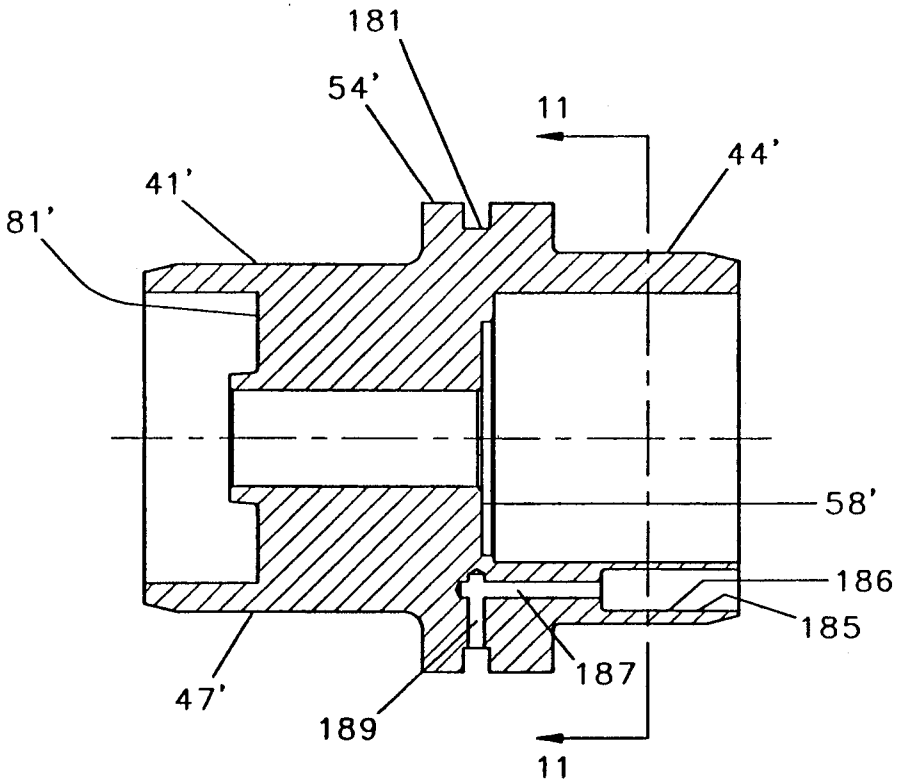
FIG. 10 is a cross sectional view of a shaft in accordance with the embodiment of the present invention depicted in FIG. 9.

Referring to FIGS. 9, 10 and 11 between the lobes 146', 147', 148' the shaft 41 are a plurality of bores 185 the axes of which are parallel to the axes of the shaft 41', and the upper portions 186 of which have a large diameter and a lower portion 187 of which have a small diameter. A cross bore 189 extends from the bottom of the groove 181 radially inward and intersects the lower portion 187 of each of the bores 185. A piston 188 is fitted slidably within each of the upper portions 186 of the bore 185 such that they will be compressed upwardly when pressurized liquid is injected through a fitting 190, into the annular groove 181, and through the intersecting bores 187, 189. The piston 188 abuts against the lower surface of a second collar 192 which is fitted slidably around the lobed portion 142' of the drill chuck 56'. The fitting 190 extends through the outer wall of the housing 12' and is retained by a secured by a fitting block 191 secured to the housing 12' by a plurality of bolts 193.

A hardened steel ball 194 is retained by an inner lip 195 within each of three spaced radial holes 196 in the drill chuck 56'. The hardened ball 194 will be compressed against the side of a drill steel 165 fitted within the drill chuck 56' by an inclined ramp 200 on the inner edge of the second collar 192.

Figure 12:
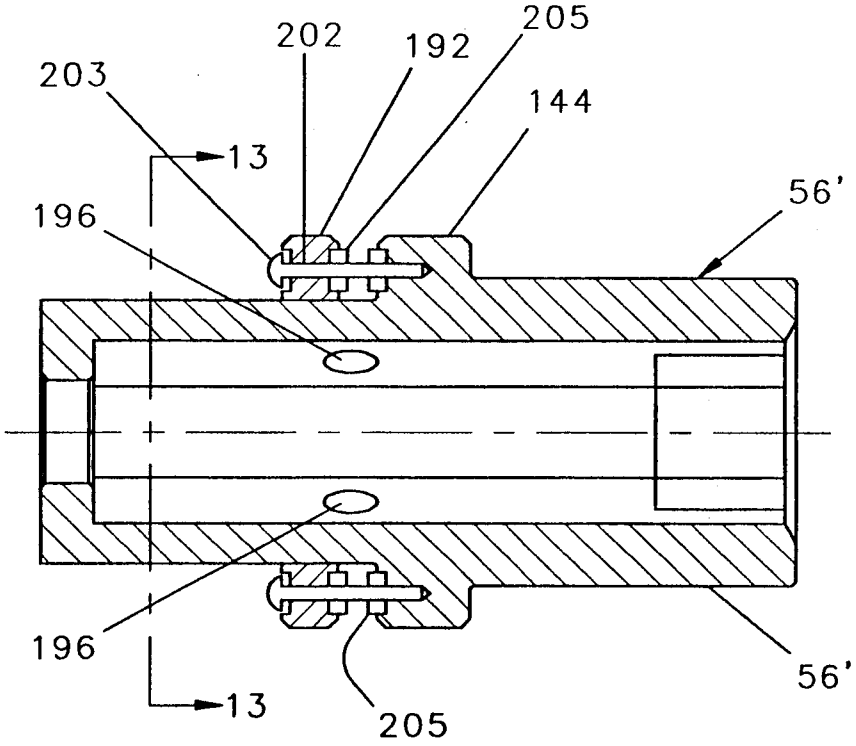
FIG. 12 is a cross sectional view of a drill chuck in accordance with the embodiment depicted in FIG. 9.
Figure 13:
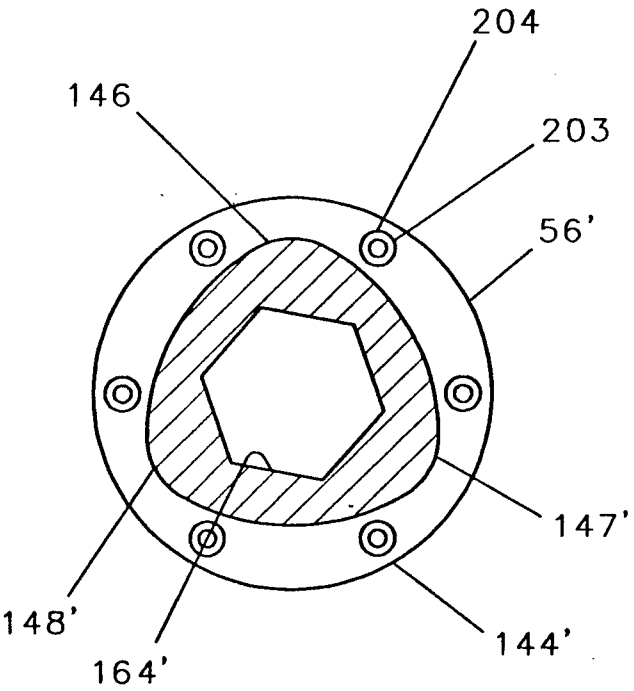
FIG. 13 is a cross sectional view of a drill chuck shown in FIG. 12 taken through line 13—13.

As best shown in FIGS. 12 and 13, a plurality of pins 202 having enlarged heads 203 extend slidably through a plurality of spaced holes 204 in the second collar 192 and into a plurality of aligned holes in the annular shoulder 205 of the drill chuck 56' such that the second collar 192 is attached to the drill chuck 56' by the enlarged heads 203. A spring 205 is fitted around each of the pins 202 to force the second collar 192 away from the shoulder of the chuck 56'.

Figure 14:
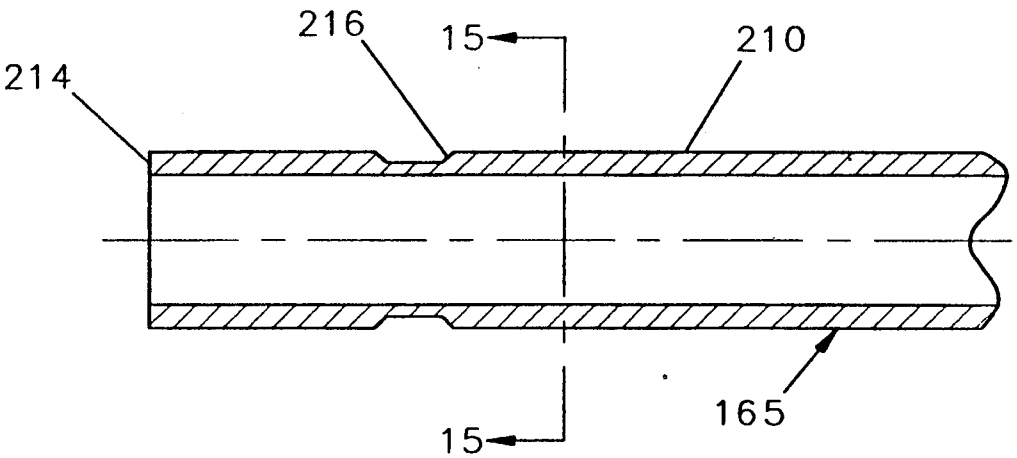
FIG. 14 is a fragmentary side elevational view of a drill steel usable in the present invention and specifically adapted for use in the embodiment shown in FIG. 9.
Figure 15:
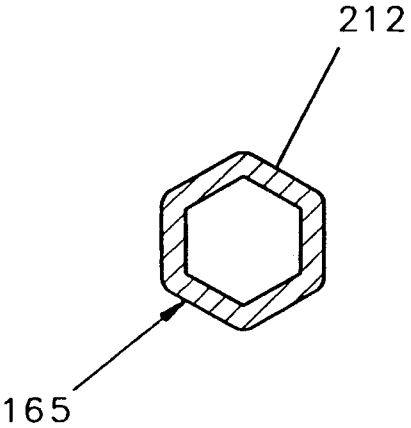
FIG. 15 is a cross-sectional view of the drill steel shown in FIG. 14 taken through the line 15—15 thereof.

Referring to FIGS. 14 and 15, a drill steel 165 in accordance with the present invention has a hollow shaft 210 with a hexagon outer shape 212. The outer dimensions of the hexagon 212 shaft 210 are such that the lower end 214 of the drill steel 165 will fit slidably into the hexagon bore 164' of the drill head unit 10'.

Around the outer surface of the drill steel 165 is an annular groove 216 which is positioned a distance from the lower end 214 of the drill steel 165 which is equal to the distance that the radial holes 196 are above the upper surface of the spring loaded washer 59' fitted below drill chuck 56'. When the lower end 214 of the drill steel 165 is fitted in the drill chuck 56', the hardened steel balls 194 fitted in the radial holes 196 will then be positioned adjacent the grooves 216 on the drill steel 165. A drill which does not have an annular groove 216 may be used with this embodiment, however, the ability of the locking mechanism 180 to retain the drill steel within the drill chuck 56' will be somewhat reduced.

When a source of pressurized hydraulic fluid is applied to the distal end of the fitting 190, and pressurized liquid is admitted into the fitting, the liquid will enter the annular groove 181 on the shaft 56' and enter the borings 185, 189 therein. The pressurized liquid will cause the pistons 188 to move upwardly, and move the second collar 192 upwardly to compress the spring 205. The upward movement of the second collar 192 will also force the inclined ramps 200 against each of the steel balls 194 and compress the steel balls 194 into the groove 216 around the drill steel 165. Accordingly ,the drill steel 165 will be locked to the drill head when hydraulic pressure is applied to the fitting 190. After a hole has been drilled in the roof of a mine, and the drill head unit 10' is lowered, the locking mechanism 180 will then withdraw the drill steel from the hole as the drill head unit 10' is lowered.

When the hydraulic pressure is released from the fitting 190, the spring 205 will move the second collar 192 and the pistons 188 downwardly and permit the drill steel 165 to be removed.

While the present invention has been described in connection with one embodiment, it will be understood by those in the art that many changes may be made without departing from the true spirit and scope of the present invention. Therefore, it is intended by the appended claims to cover all such changes and modifications which come within the true spirit and scope of this invention.

What is claimed:

1. A drill head unit for transmitting rotational power from a horizontally oriented motor to a vertically oriented hollow drill bit comprising;

a housing having a first cavity therein for enclosing a gear assembly, a first spiral bevel gear mounted in said first cavity and journaled for rotation about a vertical axis, said first spiral bevel gear having a central opening in a top thereof, a hollow drill chuck, a portion of said drill chuck having a plurality of equally spaced lobes around a circumference thereof, each of said lobes having a crest, said first spiral bevel gear further having a hollow shaft extending downwardly below said central opening, said first spiral bevel gear having a tubular member having a plurality of recesses which are complementary in shape to said plurality of lobes around the circumference of said drill chuck for slidably receiving said drill chuck within said first spiral bevel gear to transmit rotational power to said drill chuck, said first spiral bevel gear having contact areas and relief areas spaced around said central opening, said contact areas positioned to exert rotational force to said drill chuck at positions having an angle of between about 8 degrees and about 30 degrees from said crest of each of said lobes, a second cavity in said housing below said first bevel gear, said second cavity being in communication with said central opening in said first spiral bevel gear, a tubular projection above said second cavity extending upwardly, a port in said housing opening into said second cavity through which a fluid may flow, first sealing means between said tubular projection and said downwardly extending hollow shaft for sealing said first cavity from said second cavity, a spiral bevel pinion mounted in said first cavity and journaled for rotation about a horizontal axis, said spiral bevel pinion being adapted to engage said first spiral bevel gear, attachment means for attaching said spiral bevel pinion to a shaft of said motor, second sealing means for sealing said first spiral bevel gear against said housing, and third sealing means for sealing said spiral bevel pinion against said housing.

2. A drill head unit in accordance with claim 1 and further comprising means for locking a drill steel into said drill chuck.

* * * * *

UNITED STATES PATENT AND TRADEMARK OFFICE

CERTIFICATE OF CORRECTION

PATENT NO. : 5,330,013

DATED : July 19, 1994

INVENTOR(S) : Phillip A. Sollami

It is certified that error appears in the above—identified patent and that said Letters Patent is hereby corrected as shown below:

In column 6, line 43, after "but" delete "then" and substitute -- the --.

In column 7, line 27, after "surface" insert -- at --.

In column 8, line 12, beginning of the line, delete "An" and substitute -- The --.

In column 11, line 34, after "the" delete "lobes".

In column 11, line 35, beginning of the line delete "146', 147', 148'" and substitute -- recesses 63', 64', 66' of --.

In column 11, line 50, after "retained by a "delete "secured by a".

In column 12, line 59, after "thereof," insert -- for receiving --.

Signed and Sealed this

Twenty-fifth Day of April, 1995

*Attest:*

Bruce Lehman

BRUCE LEHMAN

*Attesting Officer*

*Commissioner of Patents and Trademarks*